US011833440B2

(12) United States Patent
Moore et al.

(10) Patent No.: US 11,833,440 B2
(45) **Date of Patent: *Dec. 5, 2023**

(54) INFLATABLE ORNAMENT APPARATUS

(71) Applicant: HOLIBALL INC., Houston, TX (US)

(72) Inventors: Kristy Moore, Friendswood, TX (US); Jennifer Leigh Couch, Houston, TX (US); Amberly Hall, Houston, TX (US)

(73) Assignee: HOLIBALL INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/203,686

(22) Filed: May 31, 2023

(65) Prior Publication Data

US 2023/0302376 A1 Sep. 28, 2023

Related U.S. Application Data

(63) Continuation of application No. 29/866,778, filed on Sep. 27, 2022, and a continuation of application No.
(Continued)

(51) Int. Cl.
*A63H 27/10* (2006.01)
*F21V 3/02* (2006.01)
*F21Y 115/10* (2016.01)

(52) U.S. Cl.
CPC ..... *A63H 27/10* (2013.01); *F21V 3/023* (2013.01); *A63H 2027/1058* (2013.01); *A63H 2027/1075* (2013.01); *F21Y 2115/10* (2016.08)

(58) Field of Classification Search
CPC ..... A63H 27/10; A63H 2027/1041; A63H 2027/1058; A63H 2027/1075; A63H 2027/1091
(Continued)

(56) References Cited

U.S. PATENT DOCUMENTS 1,530,923 A * 3/1925 Falkner ..... A63H 27/10 446/224
1,858,991 A 5/1932 Frost
(Continued)

FOREIGN PATENT DOCUMENTS

CN 201295115 Y 8/2009
DE 1776183 U 10/1958

OTHER PUBLICATIONS

Title: Giant Inflatable Ornaments, The GreenHead Finds Cool New Stuff; URL: https://www.thegreenhead.com/2009/11/giant-inflatable-ornaments.php/ (published Nov. 29, 2009; date accessed Nov. 30, 2022).

(Continued)

*Primary Examiner* — Joseph B Baldori
(74) *Attorney, Agent, or Firm* — Harness, Dickey & Pierce, PLC

(57) ABSTRACT

An inflatable globe has a generally round shape and an attachment pin, plug or other closure mechanism coupled to the top of the inflatable globe. A topper is configured to fit over the attachment pin, plug or other closure mechanism. A hanger is threaded through the attachment pin, plug or closure mechanism and then through the topper. An electric light coupled to the plug is suspended inside the globe. The inflatable globe is made of a resilient polymer material and can be monochromatic or comprise a plurality of colors.

30 Claims, 7 Drawing Sheets

Related U.S. Application Data

29/866,776, filed on Sep. 27, 2022, said application No. 29/866,778 is a continuation of application No. 17/187,072, filed on Feb. 26, 2021, now Pat. No. 11,484,808, said application No. 29/866,776 is a continuation of application No. 17/187,072, filed on Feb. 26, 2021, now Pat. No. 11,484,808.

(60) Provisional application No. 62/989,225, filed on Mar. 13, 2020.

(58) Field of Classification Search
USPC ..... 446/220, 222
See application file for complete search history.

(56) References Cited

U.S. PATENT DOCUMENTS

| | | | | | |
|---|---|---|---|---|---|
| 2,619,303 | A | | 11/1952 | Martin | |
| 3,035,162 | A | * | 5/1962 | Emmich | A47G 33/08 362/267 |
| 3,694,648 | A | * | 9/1972 | Yates | A47G 33/08 362/311.06 |
| 3,900,638 | A | | 8/1975 | Du Bato | |
| 4,358,487 | A | | 11/1982 | Walker | |
| 4,452,836 | A | * | 6/1984 | Daniel, Jr. | A47G 33/10 362/396 |
| 4,934,986 | A | | 6/1990 | Wallace | |
| 5,117,344 | A | * | 5/1992 | Perez | A63H 27/10 362/253 |
| 5,119,281 | A | | 6/1992 | Akman | |
| 5,378,512 | A | * | 1/1995 | Van Wyk | F21S 4/10 428/34.4 |
| 5,714,211 | A | * | 2/1998 | Zinbarg | A47G 33/08 446/268 |
| 6,048,591 | A | * | 4/2000 | Zwiebel | A47G 33/08 428/12 |
| 6,217,956 | B1 | * | 4/2001 | Heidkamp | A47G 33/08 428/34.4 |
| 7,077,553 | B2 | * | 7/2006 | Vanderschuit | G09F 21/10 362/253 |
| 7,204,740 | B2 | * | 4/2007 | Petell | G09F 21/06 362/362 |
| 7,311,580 | B2 | * | 12/2007 | Moomaw | G09F 15/0025 446/179 |
| 8,292,454 | B2 | * | 10/2012 | Schrimmer | A63H 27/10 362/195 |
| 10,907,817 | B2 | * | 2/2021 | Qin | F21V 3/026 |
| 11,287,103 | B2 | | 3/2022 | Palumbo | |
| 11,484,808 | B2 | * | 11/2022 | Moore | F21V 3/026 |
| 11,534,698 | B1 | * | 12/2022 | You | F21V 23/003 |
| 2005/0269442 | A1 | | 12/2005 | Nguyen | |
| 2007/0019403 | A1 | | 1/2007 | Boghossian | |

OTHER PUBLICATIONS

Title: DIV Giant Ornament Holiday Décor I table beach balls. | By HGTV | Facebook; URL: https://www.facebook.com/HGTV/videos/10155442862964213/ (published Nov. 8, 2017; date accessed Nov. 11, 2022).

Title: Inflatable Ornament 3m | Backdrops Fantastic Australia; URL: http://web.archive.org/web/20190324054835/https://www.backdrops.com.au/backdrops/inflatable-ornament/ (published at least as early as Mar. 24, 2019); date accessed Nov. 11, 2022.

Title: Inflatable Holiday . . . - Inflatable Holiday Ornaments; URL: https://m.facebook.com/Inflatableornaments/photos/pb.100069379472644.-2207520000./949821578430486/?type=3&_rdr (published Oct. 18, 2015; date accessed Nov. 11, 2022).

Title: LED Light Up Beach Ball—YouTube; URL: https://www.youtube.com/watch?v=7Qh6syA_gUg (published: May 22, 2017: date accessed Nov. 11, 2022).

Title: How to make a giant Light-up Christmas Ornament—YouTube URL: https://www.youtube.com/watch?v=ZPxbQQc8dJY (published Nov. 19, 2017; date accessed Nov. 11, 2022).

Title: Facebook; URL: http://www.facebook.com/refabbedbybrooke/photos/a.1578983949017919/2056135097969466/ (published Jul. 1, 2018; date accessed Nov. 8, 2022).

Title: Facebook; URL: https://www.facebook.com/stagedbydesigntx/photos/a.866509390171534/1405068849648916/ (published Oct. 14, 2018; date accessed Nov. 8, 2022).

Title: Balloon Party Lights; URL: https://web.archive.org/web/20170617173358/https://www.glow.co.uk/balloon-string-lights.html; (published Jul. 16, 2017; date accessed Nov. 10, 2022).

* cited by examiner

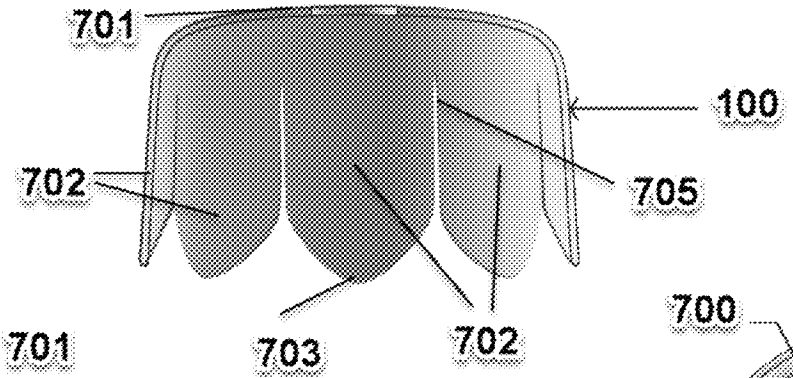
FIG. 7
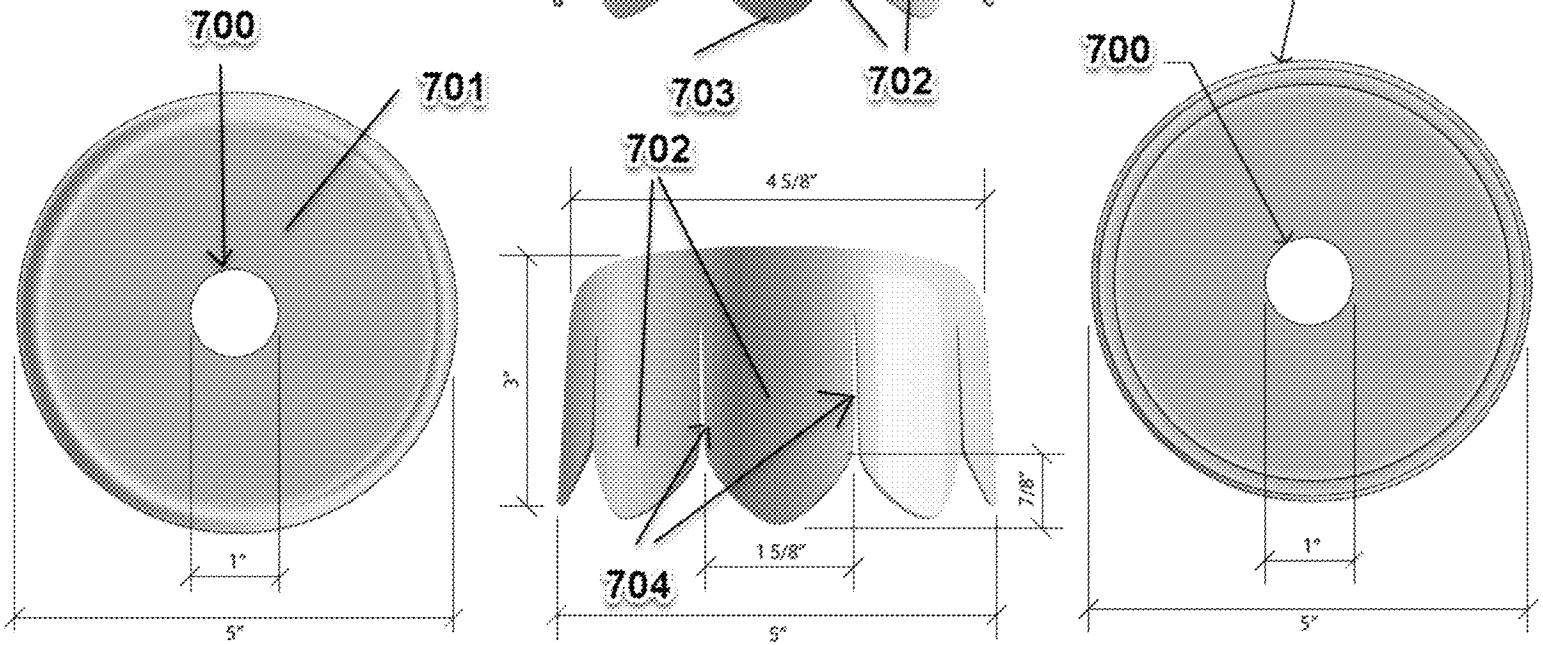
FIG. 8
FIG. 9
FIG. 10

INFLATABLE ORNAMENT APPARATUS

CROSS REFERENCE TO RELATED APPLICATIONS

This application is a continuation of U.S. patent application Ser. No. 29/866,778, filed on Sep. 27, 2022, which is a continuation of U.S. patent application Ser. No. 17/187,072, filed on Feb. 26, 2021 which issued as U.S. Pat. No. 11,484,808, which claims priority to U.S. Provisional Patent Application No. 62/989,225, filed on Mar. 13, 2020, all of which are incorporated by reference herein.

This application is also a continuation of U.S. patent application Ser. No. 29/866,776, filed on Sep. 27, 2022, which is a continuation of U.S. patent application Ser. No. 17/187,072, filed on Feb. 26, 2021 which issued as U.S. Pat. No. 11,484,808, which claims priority to U.S. Provisional Patent Application No. 62/989,225, filed on Mar. 13, 2020, all of which are incorporated by reference herein.

TECHNICAL FIELD

The present invention relates to holiday ornaments.

BACKGROUND OF THE INVENTION

Holiday ornaments, baubles, "Christmas bulbs" or "Christmas bubbles" or "Christmas balls" are decorations that are usually made of blown glass, metal, wood, blown plastics, expanded polystyrene or ceramics and are typically used to decorate a Christmas tree. Ornaments take many different forms, from a simple round ball to highly artistic designs. Ornaments are almost always reused year after year rather than purchased annually, and family collections often contain a combination of commercially produced ornaments and decorations created by family members. Such collections are often passed on and augmented from generation to generation.

Such holiday ornaments are small in size, having circumference of between 2 inches and 5 inches. What is desired is a much larger ornament made of a resilient material that is capable of being deployed in the outdoors in yards or on live trees, and which can be internally illuminated. The invention comprises such an ornament.

SUMMARY OF THE INVENTION

The invention is an inflatable, resilient, plastic polymer globe with a plastic-coated topper and hanger for use as a holiday decoration. The invention can be deflated to allow efficient storage. The invention has several components including the inflatable globe with attachment pin, light source, closure mechanism, topper and hanger. While the invention is directed for use as a Christmas ornament, it can be used without the topper for other occasions.

To those skilled in the art to which this invention relates, many changes in construction and widely differing embodiments and applications of the invention will suggest themselves without departing from the scope of the invention as defined herein. The disclosures and the descriptions herein are purely illustrative and are not intended to be in any sense limiting.

BRIEF DESCRIPTION OF THE DRAWINGS

For a better understanding of the present invention including the features, advantages and specific embodiments, reference is made to the following detailed description along with accompanying Figures, in which:

FIG. 7 is a cross-sectional view through the topper of the invention;

FIG. 8 is a top view of the topper of the invention;

FIG. 9 is a side view of the topper of the invention; and

FIG. 10 is a bottom view of the topper of the invention.

DETAILED DESCRIPTION

Figure 1:
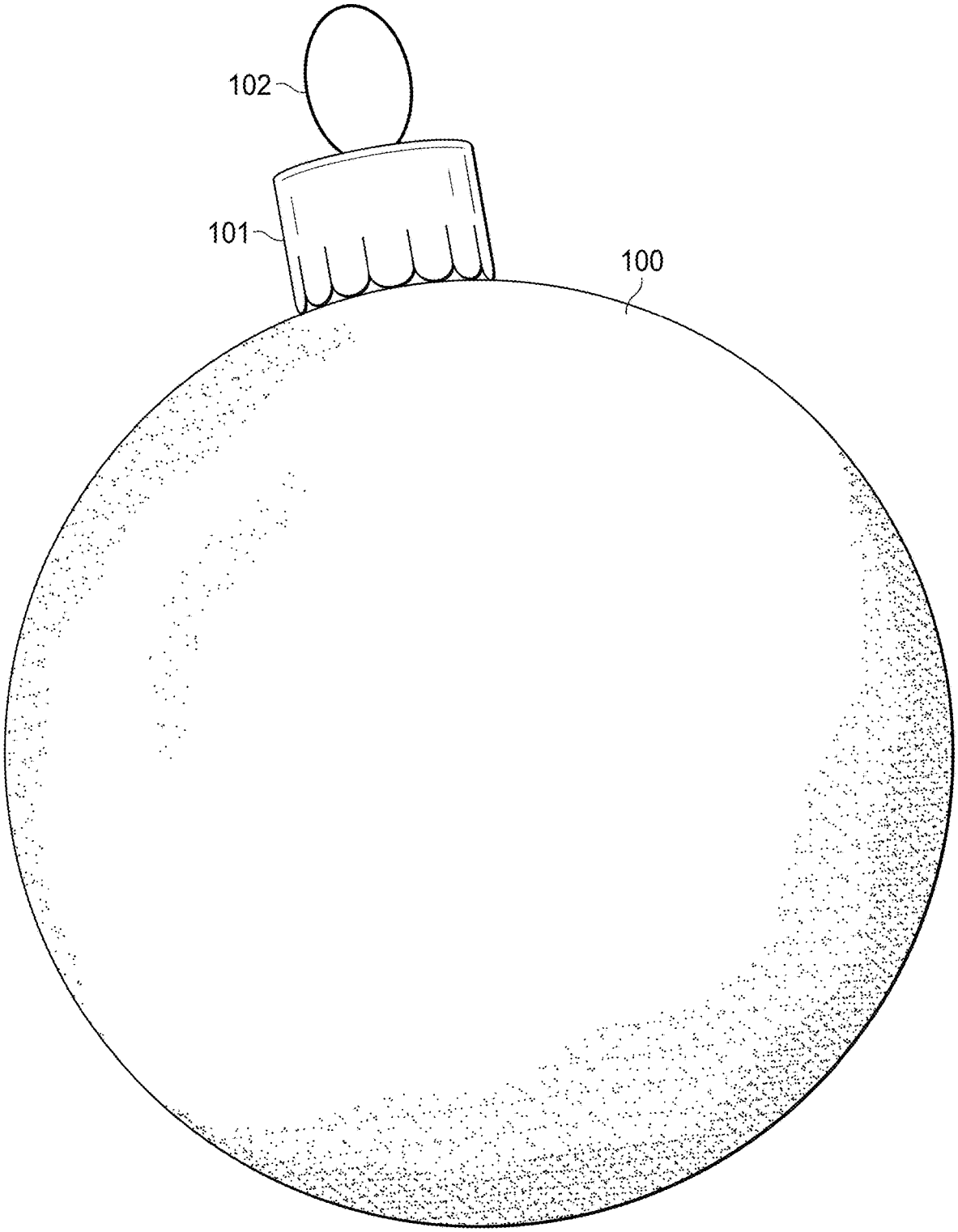
FIG. 1 is a side-view of the assembled invention in an embodiment.

While the making and using of the disclosed embodiments of the present invention is discussed in detail below, it should be appreciated that the present invention provides many applicable inventive concepts which can be embodied in a wide variety of specific contexts. Some features of the preferred embodiments shown and discussed may be simplified or exaggerated for illustrating the principles of the invention.

The invention is an inflatable, resilient, plastic polymer globe for use as a holiday decoration. More specifically, the invention is a holiday apparatus, comprising an inflatable globe having a generally round shape and circumference of between 2 feet and 10 feet with an opening allowing ingress into the interior of the globe. A closure mechanism securely couples to opening into the inflatable globe thus restricting the egress of air from the inflatable globe. A topper is configured to fit over the closure mechanism and a hanger is configured to be threaded through the closure mechanism. Without limiting the materials used to make the invention in an embodiment, the inflatable globe is made of a resilient polymer material and the topper is made of a molded plastic material. The topper comprises a cylindrical shape having a substantially closed upper surface with an orifice therethrough for accepting the closure mechanism and hanger and a side extending down from the upper surface. Further, the topper has a finish that is selected from the group consisting or electroplated and painted. The opening into the inflatable globe can be a threaded attachment pin having a cylindrical orifice being a conduit into the interior of the globe. The closure mechanism couples to the attachment pin at the top of the inflatable globe. Alternatively, the opening is a inwardly cylindrical portion of the inflatable globe that extends into the interior of the inflatable globe and the closure mechanism is a plug that is received into the opening. A light source can be located at an end of said plug, said light source being a compact electric light source such as a Light-Emitting Diode and powered by one from the group consisting of an internal battery, external battery unit and solar panel via wires extending through said attachment pin and topper. Further, the closure mechanism can comprise a threaded portion configured to be coupled to the integrated attachment pin. The hanger can be made from one selected from the group consisting of steel, plastic, string, and cord.

The inflatable globe can be red or green or other color and can be monochromatic or having a pattern of a plurality of colors.

The invention further comprises an inflatable globe having a generally round shape and circumference of between 2 feet and 10 feet and an opening into the interior of the globe located at the top of said inflatable globe. A removable ribbed plug is configured to be received into the opening in the top of said globe having a conical flared stopper near its midpoint, and a through-hole at its upper end and is operable to maintain air pressure in said inflatable globe when inserted. Further, a topper is configured to fit over the removable threaded attachment pin and a hanger is threaded through the through-hole at the upper end of said removable attachment pin.

This embodiment of the invention further comprises a light source at an end of said removable ribbed plug, said light source being a compact electric light source such as a Light-Emitting Diode and wherein said light source is powered by one from the group consisting of an internal battery, external battery unit and solar panel via wires extending through said attachment pin and topper. A further embodiment of the invention is an inflatable holiday apparatus, comprising an inflatable globe with an attachment pin, said attachment pin extending a short distance through a threaded or ridged opening on the top of said inflatable globe such that one end of said attachment pin defined as the interior end is inside said globe when assembled, said attachment pin comprising a threaded section corresponding to said threaded or ridged opening on the top of said inflatable globe. Said embodiment further includes a topper, a hanger, and a light source at said interior end of said attachment pin, said light source being a compact electric light source such as a Light-Emitting Diode wherein said light source is powered by one from the group consisting of an internal battery, external battery unit and solar panel via wires extending through said attachment pin and topper.

Figure 2:
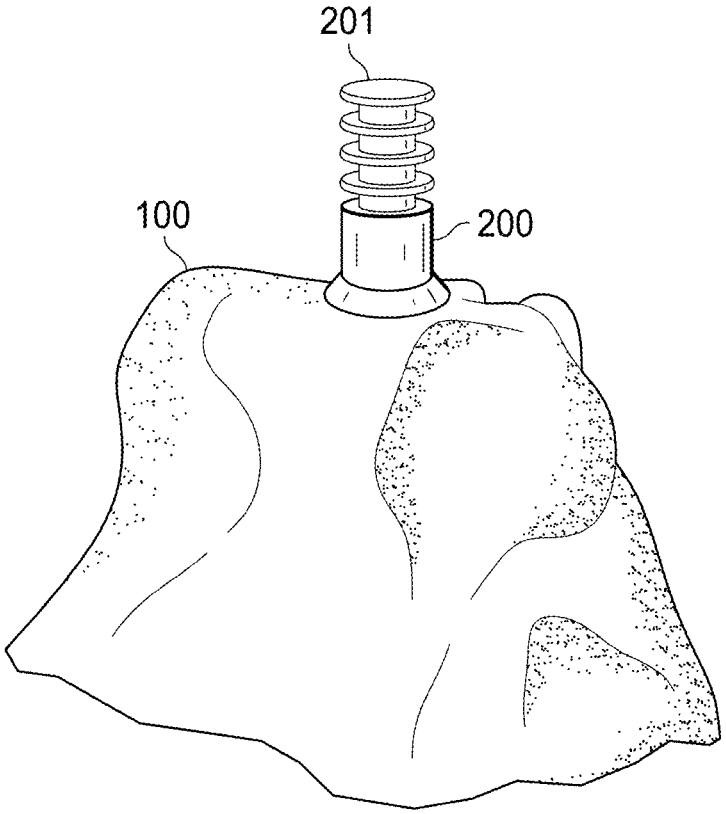
FIG. 2 is a close view of the globe component in a deflated state in an embodiment of the invention.
Figure 3:
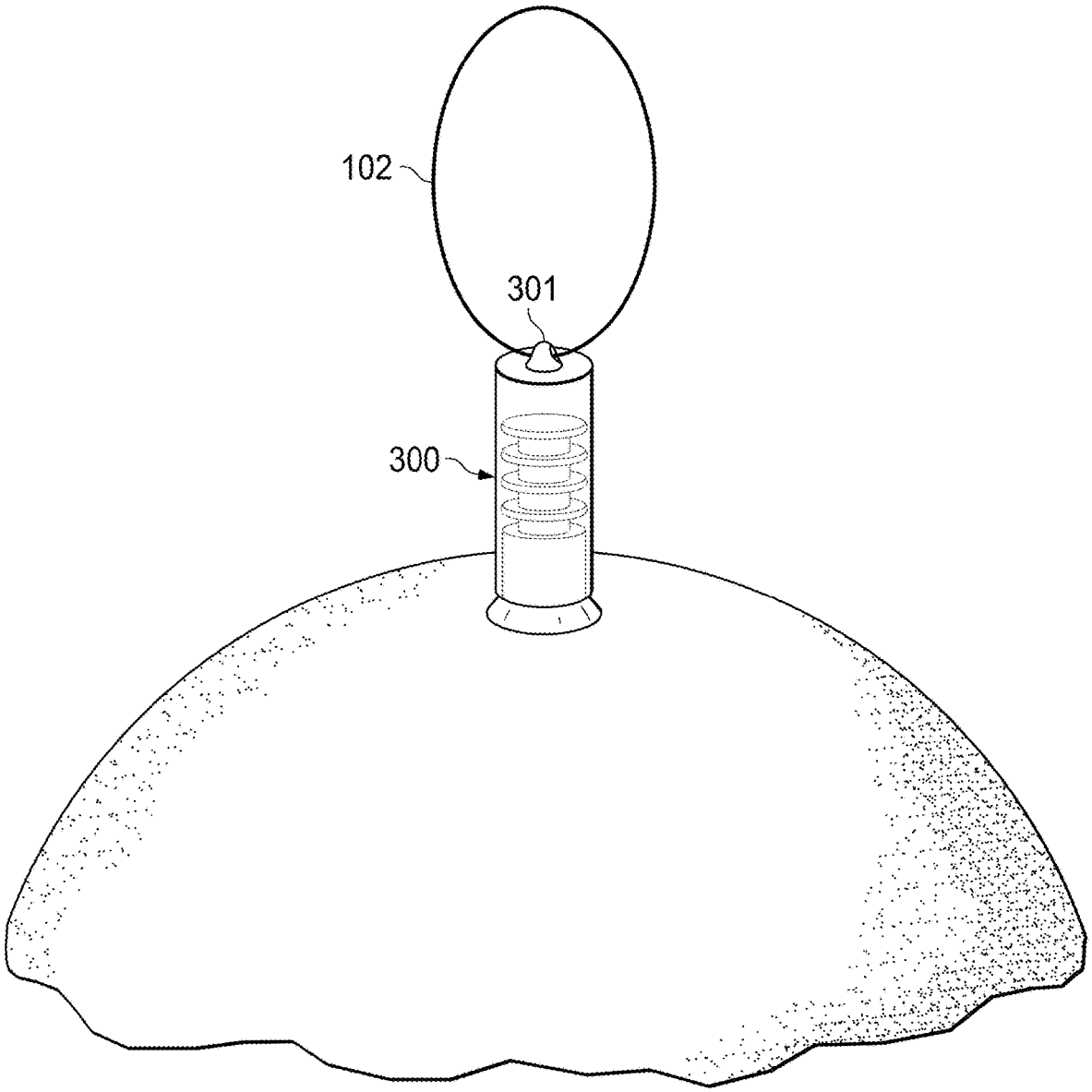
FIG. 3 is a close view of the assembled inflated globe, closure mechanism, and hanger components in an embodiment of the invention.
Figure 4:
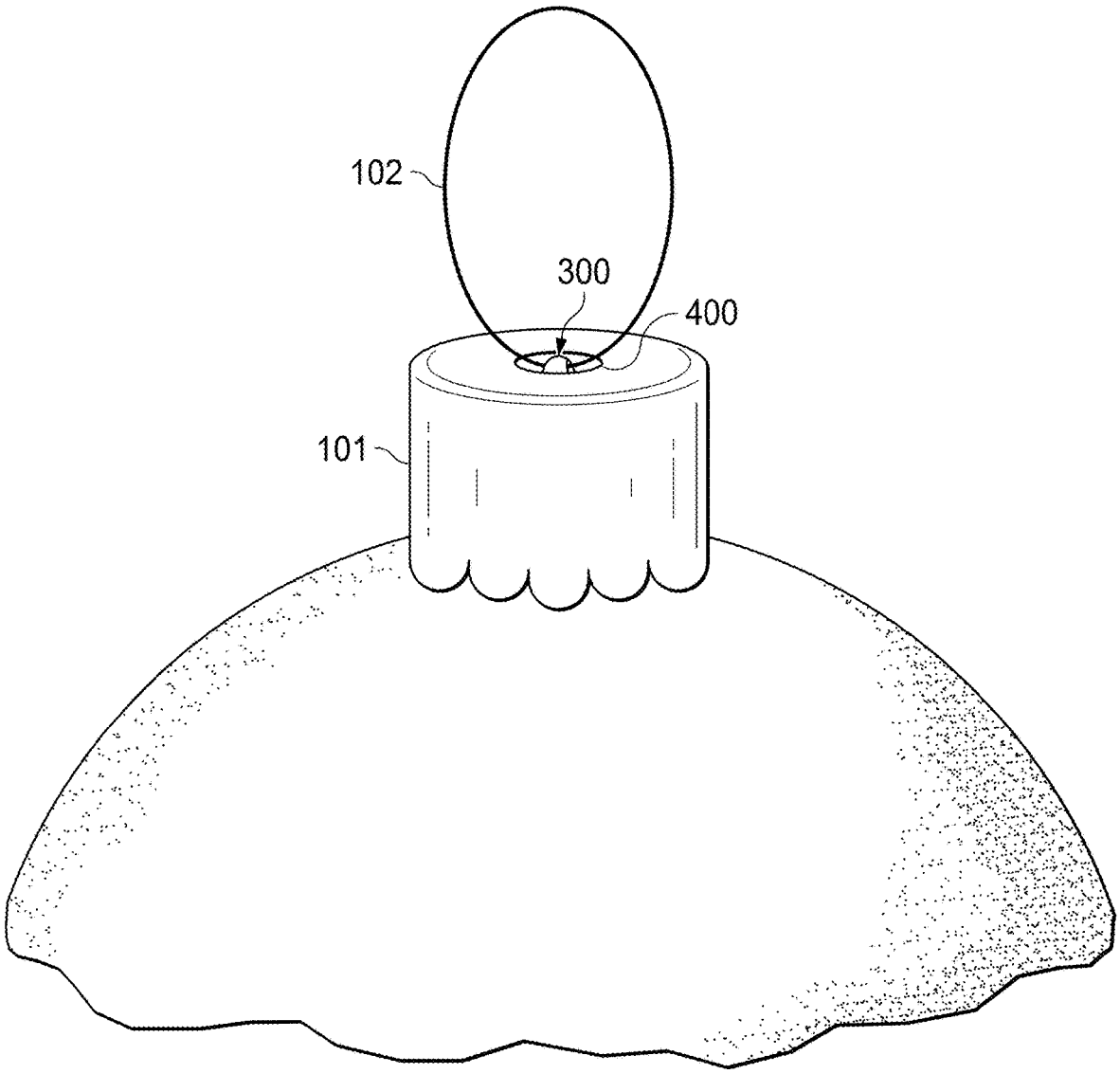
FIG. 4 is a close view of the assembled inflated globe, hanger, and topper components in an embodiment of the invention.

Now referring to the Figures, in an embodiment the invention has several components. As seen in FIG. 1, these include an inflatable globe 100 having a topper 101 and hanger 102. Closure mechanism 300 (seen in FIG. 3) is located under topper 101. FIG. 2 shows deflated inflatable globe 100, integrated attachment pin 200, and external threaded or ridged section 201. Referring to FIG. 3, said closure mechanism 300 comprises a hollow cylinder having at its upper end an endcap and extended loop opening 301, and having an internal threaded or ridged section extending inward from its interior surface, said threaded or ridged section corresponding to an external threaded or ridged section 201 on the outer surface of said integrated attachment pin 200. Following inflation of inflatable globe 100, closure mechanism 300 is fitted to attachment pin 200 such that air pressure is maintained inside said globe. Referring to FIG. 4, hanger 102 is looped through opening 301 at the upper end of the closure mechanism 300. Said hanger 102 is then compressed by a user such that it presents a smaller diameter and inserted through an opening 400 in the upper surface of topper 101, topper 101 then being lowered on to the closure mechanism 300. Said hanger 102 can be made of steel, plastic, string, cord or similar material.

Figure 5A:
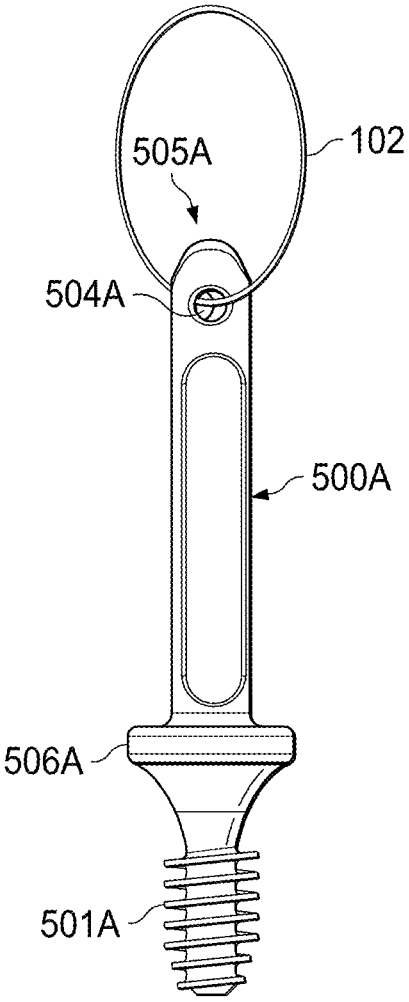
FIGS. 5A and 5B are side views of the pin and plug components used with embodiments of the invention.
Figure 5B:
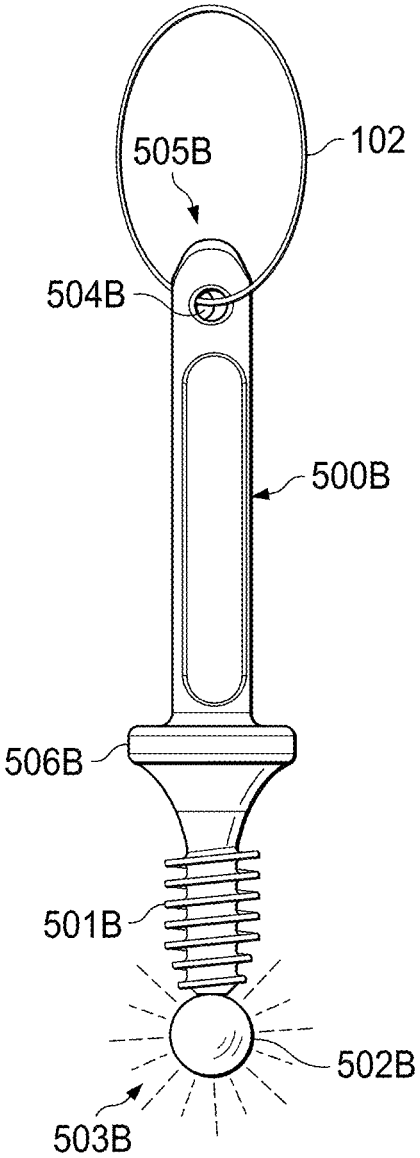
Figure 6:
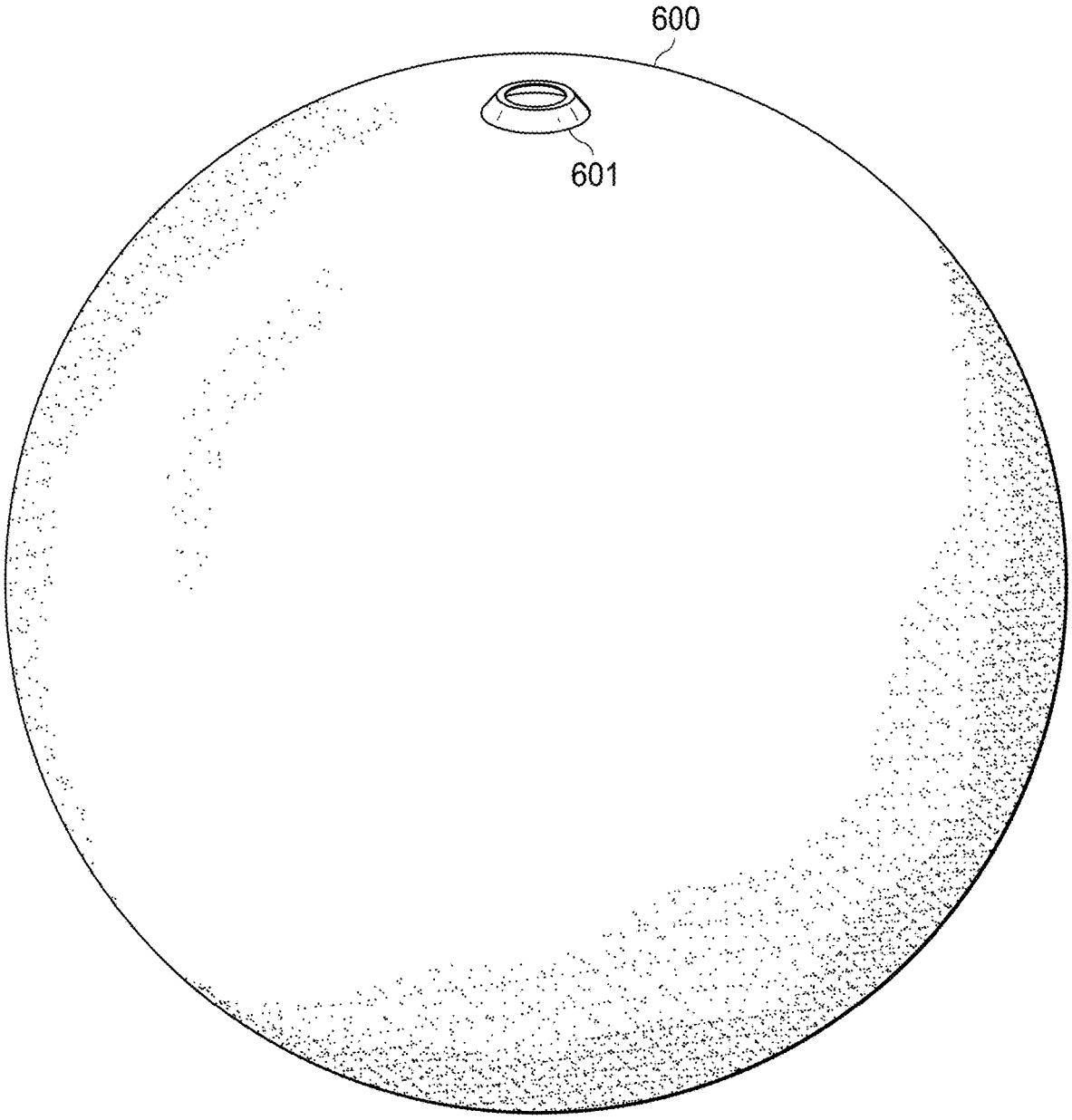
FIG. 6 is a close view of the globe component of the further embodiment of the invention.

In another embodiment, referring to FIGS. 5A, 5B and 6, the components of the invention include an inflatable globe 600, topper, hanger 102, and plug 500A, 500B, said plug 500A, 500B extending a short distance through a threaded or ridged opening 601 on the top of said inflatable globe 600 such that one end of said plug 500A, 500B defined as the interior end is inside said globe when assembled, said plug comprising a threaded or ribbed section 501A, 501B corresponding to said threaded or ridged opening 601 on the top of said globe and operable to retain air inside the inflatable globe. As seen in FIG. 5B, and a light source 502B at said interior end 503B of said plug 500B, said light source 502B being a compact electric light source such as a Light-Emitting Diode; said light source is powered by an internal battery, external battery unit or solar panel via wires extending through said plug and topper. The hanger 102 is looped through an opening 504A, 504B located at the exterior end 505A, 505B of plug 500A, 500B, said exterior end 505A, 505B being outside said inflatable globe when invention is assembled. In this embodiment, plug 500A, 500B further comprises at its midpoint a flared conical stopper 506A, 506B to maintain air pressure in said inflatable globe when said plug 500A, 500B is inserted.

An advantage of the invention is that it can be inflated to a circumference of several feet or meters and then be deflated after use to allow for efficient storage. The invention includes an ultraviolet (UV) resistant coating, and is durable for use in any weather condition.

The invention is preferably inflated with an electric fast flow inflator. In an embodiment, referring to FIGS. 2 through 4, once globe 100 is at its desired size, the attachment pin 200 on the globe 100 is plugged with the closure mechanism 300. The hanger 102 is coupled to the closure mechanism 300. The topper 101 is placed over the closure mechanism 300. The inflated ornament can then be hung to a tree or tethered to the ground.

In a further embodiment, referring to FIGS. 5 and 6 once globe 600 is at its desired size, the plug 500A, 500B is inserted through opening 601 in globe 600. The hanger 102 is coupled to the plug 500A, 500B. The topper is placed over the hanger and plug. In a further embodiment, a light source such as a light emitting diode can be positioned at the end of the plug and powered by an internal or external power source. The inflated ornament can then be illuminated and hung to a tree or tethered to the ground. The illumination is further adapted to be controlled by a local switch or timer. Illumination can also be controlled by a remote device such as a standalone unit or smartphone running a dedicated application, control signals being sent to electronics integrated into said attachment pin or topper by wireless means such as 2.4 GHz radio or Bluetooth™, said integrated electronics including a receiving antenna, non-volatile memory, and processor capable of running a program in the form of instructions stored in said memory.

The topper is comprised of a resilient material such as molded plastic and is electroplated or painted with a shiny finish to suggest the appearance of a glass ornament. While the invention is directed for use as a Christmas ornament, it can be used without the topper for other occasions.

More generally, the invention is a holiday apparatus comprising an inflatable globe having a generally round shape and circumference of between 1 foot and 20 feet. When plugged, the globe is impervious to release of air that is injected therein prior to plugging. An attachment pin is attached or coupled to the top of the globe for accepting a closure mechanism. A topper is configured to fit over the closure mechanism. A hanger is threaded through an orifice at the end of the closure mechanism and through an opening or orifice in the top surface of the topper.

The inflatable globe is preferably made of a resilient polymer material. The topper is preferably made of a molded plastic material and comprises a cylindrical shape having a substantially closed upper surface with an orifice therethrough for accepting the attachment pin, closure mechanism and hanger and a cylindrical side wall extending down from the upper surface. In an embodiment, the side wall of the topper has decorative notches cut into the side thereof. The topper is electroplated or painted or can be molded into its final color. The closure mechanism is preferably a threaded plug but also can be any suitable mechanism configured to keep injected air from escaping from the globe. The hanger that is threaded through the plug is made from a material selected from the group consisting of steel, plastic, string, cord or similar material. The globe is monochromatic or can be comprised of a plurality of colors.

In an embodiment the inflatable ball further comprises an electronic light such as an LED suspended therein, said light being powered by a replaceable or rechargeable battery, or solar panel or other external power source. In an embodiment, said light is coupled to a switch and can be set to on or off. In another embodiment, said light is coupled via a wireless receiver to a remote control and can be set to on or off using said remote. In a further embodiment, the inflatable ball comprises multiple lights such as LEDs suspended therein, said lights emitting different or varied colors, and the desired emitted light color can be controlled via said switch or remote by mixing the intensity of the individual lights.

In another embodiment, the diameter of the inflated globe is 30 inches or 18.5 inches. More specifically referring to FIGS. 7-10, topper 100 includes a single, 1 inch diameter and central hollow hole 700 centrically located within an upper laterally enlarged surface 701 with a top view peripheral diameter of 5 inches. The topper further includes multiple downwardly and longitudinally extending fingers 702, each having a curved and arcuately pointed end 703 opposite upper surface 701. An elongated and longitudinally extending slot or gap 704 is located between lateral side edges 705 of each pair of fingers 702, and each slot 704 extends over a majority distance between end 703 and upper surface 701 of each adjacent finger 702. Each finger 702 is longitudinally longer than wider. Moreover, the topper is ⅛ inch thick plastic, with chrome plated silver and chrome plated gold options.

The embodiments shown and described above are only exemplary. Even though numerous characteristics and advantages of the invention have been set forth in the foregoing description, the disclosure is illustrative only and changes may be made within the principles of the invention to the full extent indicated by the broad general meaning of the terms used herein. Various alterations, modifications and substitutions can be made to the disclosed invention without departing in any way from the spirit and scope of the invention.

The invention claimed is:

1. A decorative ornament comprising:

(a) an inflatable and deflatable globe having a generally round shape and a circumference of between 2 feet and 10 feet, the globe being a resilient polymer material;

(b) an air opening of the globe including an internally threaded or ridged internal surface, the air opening allowing inflation air into an interior of the globe, and the air opening being located adjacent a top of the globe;

(c) a plug removably received in and contacting the air opening to restrict undesired air egress from the interior of the globe, the plug comprising:

(i) a threaded or ribbed section;

(ii) a flared and conical stopper;

(iii) an elongated middle section, the stopper being located between the threaded or ribbed section and the middle section;

(iv) a hanger opening, the middle section longitudinally extending between the stopper and the hanger opening;

(d) a topper covering the plug and the air opening, the topper comprising:

(i) a single and centrally located hole in a laterally enlarged upper surface, the upper surface having a circular periphery;

(ii) multiple longitudinally elongated fingers downwardly extending from the upper surface with each of the fingers including a curved end;

(iii) a gap located between facing lateral edges of each pair of the fingers, each of the gaps extending a majority of a longitudinal length between the end and the upper surface; and (e) a flexible and looped hanger extending through the hanger opening in the plug, the hanger opening being accessible to the looped hanger through the single hole in the topper.

2. The decorative ornament of claim 1, wherein the topper includes a metallic material.

3. The decorative ornament of claim 1, wherein the topper includes a molded plastic material.

4. The decorative ornament of claim 1, further comprising:

(a) a light mounted to an end portion of the plug opposite the hanger opening, with the light being in the interior of the globe when the plug is inserted into the air opening of the globe; and (b) a solar panel connected to the light via wires extending through the plug and the topper.

5. The decorative ornament of claim 1, further comprising:

(a) a light mounted to an end portion of the plug opposite the hanger opening, with the light being in the interior of the globe when the plug is inserted into the air opening of the globe; and (b) an external power source connected to the light via wires extending through the plug and the topper.

6. The decorative ornament of claim 1, further comrprising:

(a) a light mounted to an end portion of the plug opposite the hanger opening, with the light being in the interior of the globe when the plug is inserted into the air opening of the globe; and (b) a battery connected to the light.

7. The decorative ornament of claim 1, wherein the hanger is configured to be hung from a tree and is threaded through the hanger opening in the plug.

8. The decorative ornament of claim 1, further comprising a remote controller configured to wirelessly control illumination of a light inside the globe.

9. The decorative ornament of claim 1, further comprising:

(a) at least one LED downwardly extending into the interior of the globe;

(b) the at least one LED being mounted to the plug with the threaded or ribbed section of the plug being longitudinally located between the at least one LED and the stopper; and (c) the at least one LED being configured to emit different colors within the globe.

10. The decorative ornament of claim 1, wherein the globe has an ultraviolet light resistant coating and has a diameter of: (a) substantially 18.5 inches or (b) 30 inches.

11. The decorative ornament of claim 1, wherein the topper and the globe have the appearance of a shiny Christmas tree ornament and the globe has a diameter of: (a) 18.5 inches or (b) substantially 30 inches.

12. The decorative ornament of claim 1, wherein the hanger is a flexible closed loop of metal, string or cord.

13. A decorative ornament comprising (a) an inflatable globe of a resilient polymer material;

(b) a single opening in the globe configured to allow inflation air into an interior of the globe;

(c) a plug received in the opening to restrict undesired air egress from the interior of the globe;

(d) a topper covering the plug and the opening, the topper comprising:

(i) a single and centrally located hole in a laterally enlarged surface;

(ii) multiple longitudinally elongated fingers downwardly extending from the upper surface with each including a curved end; and (iii) a longitudinally elongated slot located between each pair of the fingers, each of the slots extending a majority of a longitudinal length between the end and the laterally enlarged surface;

(e) a looped hanger threaded through an end section of the plug, the end section of the plug being accessible to the looped hanger through the single hole in the topper; and (f) the topper and the globe having the appearance of a shiny Christmas tree ornament.

14. The decorative ornament of claim 13, wherein the topper includes a metallic material and the hanger is flexible.

15. The decorative ornament of claim 13, wherein the topper includes a molded plastic material and the hanger is flexible.

16. The decorative ornament of claim 13, further comprising:

(a) an LED light mounted to the plug opposite the end section engaged by the hanger, the light being in the interior of the globe when the plug is inserted into the opening of the globe;

(b) wires extending through the plug and the topper; and (c) an external power source connected to the light via the wires.

17. The decorative ornament of claim 13, wherein the plug comprises:

(a) a threaded or ribbed section;

(b) an elongated middle section;

(c) a flared stopper located between the threaded or ribbed section and the middle section; and (d) the middle section longitudinally extending between the stopper and the hanger engaging end.

18. The decorative ornament of claim 13, further comprising:

(a) an ultraviolet light resistant coating on the globe; and (b) the plug including multiple longitudinally spaced apart and circular ribs, at least one of which engages the opening of the globe.

19. The decorative ornament of claim 13, further comprising:

(a) an ultraviolet light resistant coating on the globe; and (b) the plug including an external thread engaging the opening of the globe.

20. The decorative ornament of claim 13, further comprising:

(a) at least one LED light removably located within the globe, configured to emit different colors within the globe; and (b) the globe having a diameter of: (i) 18.5 inches or (ii) 30 inches.

21. A decorative ornament comprising (a) an inflatable and deflatable globe having a generally round shape and a circumference of at least 1 foot, the globe being a resilient polymer material;

(b) a single opening configured to allow inflation air into an interior of the globe, and the opening being located adjacent a top of the globe;

(c) a closure configured to be removably inserted into the opening to restrict air egress from the globe when inserted;

(d) a plastic topper, with a central and single hole in a top surface thereof; and (e) a hanger configured to extend through an aperture in the closure, the aperture being accessible to the hanger through the single hole in the topper (f) the closure comprising:

(i) a stopper including a laterally enlarged and circular periphery;

(ii) an elongated middle section which is laterally thinner than the laterally widest portion of the stopper;

(iii) a threaded or ribbed plug section being insertable into the opening of the globe, the stopper being located between the plug section and the middle section; and (iv) the middle section longitudinally extending between the stopper and the aperture.

22. The decorative ornament of claim 21, further comprising a light mounted to an end section of the closure opposite the aperture, with the light being in the interior of the globe when the closure is inserted into the air opening of the globe.

23. The decorative ornament of claim 22, further comprising a solar panel connected to the light via wires extending through the closure and the topper.

24. The decorative ornament of claim 21, wherein the plug section includes multiple longitudinally spaced apart ribs and the aperture is externally visible through the hole in the topper.

25. The decorative ornament of claim 21, wherein there is a gap between an outside periphery of the hanger and an adjacent internal surface of the aperture of the closure, when the hanger is inserted into the aperture, and the hanger having a looped shape.

26. The decorative ornament of claim 21, wherein the topper includes side wall portions with alternating notches and curved bottom edges.

27. The decorative ornament of claim 21, wherein the hanger is configured to be hung from a tree, and the topper and the globe have the appearance of a shiny Christmas tree ornament.

28. The decorative ornament of claim 21, wherein a taper is located between the stopper and the plug section.

29. The decorative ornament of claim 21, further comprising at least one LED located within the globe, configured to emit different colors within the globe.

30. A decorative ornament comprising (a) an inflatable and deflatable globe having a generally round shape and circumference of at least 1 foot, the globe being a resilient polymer material;

(b) a single opening configured to allow inflation air into an interior of the globe, and the opening being located adjacent a top of the globe;

(c) a closure removably inserted into the opening to restrict air egress from the globe when inserted, the closure comprising:

(i) a flared stopper;

(ii) an elongated middle section which is laterally thinner than the laterally widest portion of the stopper;

(iii) an opening-engagement section comprising: longitudinally spaced apart and circular ribs, or a thread;

(iv) the stopper being located between the opening-engagement section and the middle section;

(v) the middle section longitudinally extending between the stopper and an aperture; and (d) a cylindrically shaped topper comprising a single and centrally located hole in the surface, the aperture of the closure being externally accessible and visible through the hole in the topper.

* * * * *